US005258687A

United States Patent [19]

Duggan et al.

[11] Patent Number: 5,258,687

[45] Date of Patent: * Nov. 2, 1993

[54] MERCURY VAPOR DISCHARGE DEVICE

[75] Inventors: George L. Duggan, Bedford; David A. Goodman, Amesbury; Nanu Brates, Malden, all of Mass.

[73] Assignee: GTE Products Corporation, Danvers, Mass.

[ * ] Notice: The portion of the term of this patent subsequent to May 5, 2009 has been disclaimed.

[21] Appl. No.: 714,795

[22] Filed: Jun. 13, 1991

[51] Int. Cl.[5] ..... H01J 1/16

[52] U.S. Cl. ..... 313/346 R; 313/346 DC; 313/344; 313/628; 313/630; 313/631; 313/639

[58] Field of Search ..... 313/346 R, 346 DC, 571, 313/628, 631, 638, 310, 344, 350, 335, 630, 639

[56] References Cited

U.S. PATENT DOCUMENTS

| | | | |
|---|---|---|---|
| 3,170,081 | 2/1965 | Rokosz | 313/631 |
| 4,044,276 | 8/1977 | Keeffe et al. | 313/346 R |
| 4,210,840 | 7/1980 | Bhalla | 313/328 |
| 4,783,611 | 11/1988 | Vogels et al. | 313/628 X |
| 5,111,108 | 5/1992 | Goodman et al. | 313/628 X |

*Primary Examiner*—Sandra L. O'Shea
*Assistant Examiner*—Ashok Patel
*Attorney, Agent, or Firm*—Robert E. Walter; William H. McNeill

[57] ABSTRACT

In a mercury vapor arc discharge tube having a pair of electrodes, an emissive material disposed on the electrodes consists essentially of a single phase compound of $Ba_xSr_{1-x}Y_2O_4$ where x is from about 0.25 to about 0.95.

3 Claims, 1 Drawing Sheet

MERCURY VAPOR DISCHARGE DEVICE

CROSS REFERENCE TO RELATED APPLICATIONS

U.S application entitled Vapor Discharge Device, filed Dec. 14, 1990, as Ser. No. 07/627,529, now U.S. Pat. No. 5,111,108, relates to an emissive material of barium/strontium/yttrium oxide on an electrode.

FIELD OF THE INVENTION

The present invention relates to an emissive material for use in a mercury vapor discharge lamp.

DESCRIPTION OF THE PRIOR ART

High intensity discharge mercury vapor lamps have a quartz arc tube containing mercury as the light emitting member. The mercury vapor lamp arc tube uses only mercury as the fill component except for a starting gas, typically argon. The resulting lamp discharge yields the well known mercury high pressure line spectrum with infrared, visible and ultraviolet radiation. Such lamps typically have tungsten electrodes with an emissive material disposed on each electrode. U.S. Pat. No. 4,044,276 to Keeffe et al. describes an emission mix for high pressure mercury lamps comprising barium oxide, calcium oxide and hafnium oxide. A mixture of barium carbonate, calcium carbonate, and hafnium dioxide is coated on the electrode. The resulting emissive oxide mixture is formed after firing in hydrogen at 1500° C. to decompose the carbonates. The resulting emissive oxide deteriorates when exposed to ambient atmosphere by trapping water vapor. As a result, unless the fired electrodes are immediately processed into sealed arc tubes, their effectiveness will diminish rapidly with time. It is believed that both barium and calcium oxides, which are known to react vigorously and exothermally with water vapor, contributes to the instability of the emissive mixture by forming hydroxides. Additionally, exposure of barium oxide in air to carbon dioxide may result in the reformation of barium carbonate so as to add to the instability of the mixture. Due to the instability of the emissive mixture, difficulties in achieving manufacturing uniformity and consistent lamp performance may be encountered.

SUMMARY OF THE INVENTION

It is an object of the present invention, to provide an emissive material that has enhanced stability in air.

It is a further object of the invention to achieve enhanced consistency in the operation of mercury lamps manufactured from electrodes coated with the emissive material of the present invention.

In accordance with the present invention, there is provided a high pressure mercury vapor arc discharge tube comprising a pair of electrodes sealed through opposite ends thereof, a fill within said tube consisting essentially of mercury and a starting gas, and means to connect current to each electrode of said pair of electrodes, and an emissive material disposed on said pair of electrodes consisting essentially of a single phase compound of $Ba_xSr_{1-x}Y_2O_4$ wherein x is from about 0.05 to about 0.95.

DESCRIPTION OF THE PREFERRED EMBODIMENT

Figure 1:
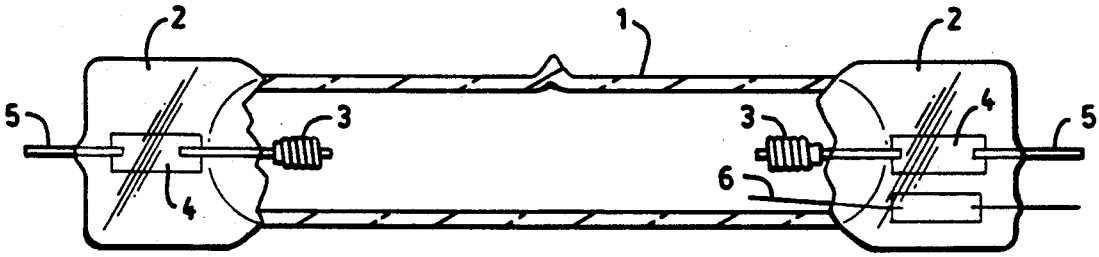
FIG. 1 is an elevational view of a high pressure mercury vapor arc discharge tube in accordance with this invention.

As shown in FIG. 1, the high pressure mercury vapor arc tube 1 is made of high silica glass, for example, quartz, includes press seals 2 at each end. An electrode 3 at each end of the arc tube 1 is connected to a molybdenum ribbon or foil 4 which is connected, in turn, to external lead-in-wire 5. The arc tube 1 includes a starting electrode 6. The ribbon 4 is utilized to obtain a glass to metal seal. In the preparation of the arc tube 1, typically, the ribbon 4 and electrode 6 components are welded together and the resulting structure is inserted into the end of the silica tube 1 which is heated to about 2050° C. and pinched onto the ribbon 4. After pinch-sealing, the arc tube is exhausted of air and filled with argon, and, depending on wattage, an accurate dose of mercury.

Figure 2:
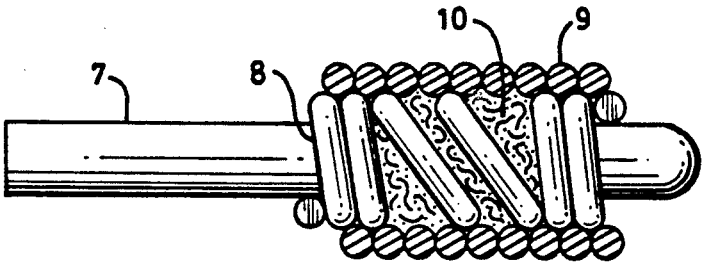
FIG. 2 is an expanded sectional view of an electrode configuration containing the emission material.

The lamp lumen maintenance, starting, and life are all dependent to some extent on the quality of the main electrodes 3. As illustrated in FIG. 2, the electrode comprises a tungsten rod 7 having an inner tungsten coil 8 encircling a portion of rod 7 and secured thereto. Outer tungsten coil 9 is threaded on coil 8. In the preferred embodiment, the coil is formed of a screw-wrapped base section of tungsten wire with an over-screw section which is backwound over the base section. The rod 7 is disposed on the axis of the windings. The emitting or emissive material 10 is disposed in the voids or recesses between coils 8 and 9. Coil 8 may have some open turns, as shown in FIG. 2, to accommodate more emitting material 10.

The emissive material disposed on each electrode consist essentially of a single phase reaction product and compound having a formula $Ba_xSr_{1-x}Y_2O_4$ wherein x is from about 0.05 to about 0.95. More preferably x is from about 0.5 to about 0.75. Although these latter compositions having a higher barium concentration are more reactive with moisture, they are preferred since the higher barium concentration results in a more emissive electrode. The higher barium content, the greater the mass loss rate. Desirably, mass loss rate of the emitter is sufficient to maintain a supply of electroactive alkaline earth metal species to the cathode emitting surface over the life of the lamp, but sufficiently low so as to be present on the electrode for the life of the lamp. If the amount of the emitter is undesirably low, the lamp suffers from poor lumen maintenance due to tungsten evaporation caused by overheating of the electrodes as electrode emission declines.

Preferably, the molar ratio of (Ba+Sr)Y is less than about 0.5, and more preferably about 0.5 to about 0.3. At ratios above 0.5, alkaline earth oxide rich phases such as BaO, SrO, or $Ba_3Y_4O_9$ may be formed. Such phases are very reactive with moisture in the air and are desirably avoided. At ratios less than about 0.5, an excess of $Y_2O_3$ is present in the reaction mixture to assure complete reaction of the barium and strontium compounds to avoid the formation of the simple oxides of barium and strontium. The final reacted emissive material desirably contains excess yttria. Typically, yttria is present in amounts less than about 10 molar percent. Preferably, the quantities of barium carbonate, strontium carbonate and yttrium oxide are reacted to produce an emitter composition, having about 2 to about 6 molar percent $Y_2O_3$ in the reacted mixture of the emitter material.

It is contemplated that the emissive material may incorporate minor amounts, preferably less than about twenty five percent, and more preferably less than about five per cent by weight of additional ingredients which do not deleterious affect the performance of the emissive material. Such additional ingredients, in addition to yttria, may also include other rare earth oxides, hafnium oxide, zirconium oxide, and other oxides such as aluminum oxide, calcium oxide, and mixtures thereof.

Starting powders are chemically reacted to form the finally reacted emissive material. It is contemplated that starting powders may be incorporated into the electrode and reacted in situ to give the finally reacted emissive material.

It is contemplated that the precursor powders may be reacted prior to incorporation on or into the electrode. Such powders may be incorporated in situ on the electrode and subsequently reacted. Typical starting powders comprise the carbonates, nitrates, hydroxides, oxalates and oxides of barium, strontium and yttrium or other materials. In preparing the coated electrodes, the precursor powders may be slurried in a suitable carrier such as methanol or water, and milled with an appropriate milling media. The resultant powder mix is dried. Such drying will typically be at about 50° C. when a methanol slurry is used and about 80° C. for a water slurry. The dried mix is then preferably fired to react the precursor materials and form a reacted mixture of barium-strontium-yttrate. The resulting compound is comminuted to an appropriate particle size and mixed with a suitable carrier. The resulting slurry containing the emissive mix is coated on the respective electrodes.

Example 1

One mole of barium carbonate, one mole of strontium carbonate, and 2.08 moles of yttrium oxide powders were admixed, slurried in methanol, and vibration ball milled with zirconia for two hours. The resultant powder mix was dried at about 50° C. and then fired in air at 1500° C. for twenty-two hours to produce a reacted mixture of barium, strontium, and yttrium oxides. In particular, $Ba_{0.5}Sr_{0.5}Y_2O_4$ was produced. This compound was then vibration ball milled in methanol with zirconia media. The material resulting from this process was shown by X-ray diffraction analysis and scanning electron microscopy (SEM) analysis to be almost entirely the single phase compound having the above formula with about 4% $Y_2O_3$.

Example 2

About 83.97 grams of barium carbonate, 62.80 grams of strontium carbonate, and 200 grams of yttrium oxide were placed in a 1000 ml polyethylene bottle that is about one-half filled with zirconia grinding media. Deionized water is added so as to cover the ingredients. Next, the bottle is placed on a roller mill and milled at 60 rpm for about 4 hours. After milling, the resulting slurry is poured into beaker and the milling media is rinsed twice with water and added to the slurry. Next, the resulting mixture is placed in a drying oven at 85° C. and evaporated to dryness. Final drying is performed at 150° C. for about 4 hours. The resulting precursor mix is scraped out and ground in a mortar and pestle. The mix is then placed in an alumina crucible. The crucible is placed into a furnace and heated for 6 hours to about 1500° C. After 23 hours of heating at 1500° C., the furnace is cooled over a 6-hour period of time and the crucible removed. The resulting material was identified by x-ray diffraction analysis to be almost entirely the single phase compound having the above formulation, $Ba_xSr_{1-x}Y_2O_4$, wherein is 0.50 with a about 4% of yttrium oxide being present. The material was mixed with zirconia grinding media as previously set forth in methanol and roller milled at 60 rpm for about 6 hours. The resulting slurry was separated from the milling media with the milling media being rinsed in methanol. The average particle size of the reacted emissive material was about 3.5 microns. The resulting slurry contained 575 grams of the emissive material having the above formula with 850 ml of methanol. About 2500 coils were impregnated with the slurry. H100W mercury lamps were subsequently manufactured from the coated electrodes prepared in the above manner. The lamps were life tested. The 100 hour and 500 hour photometry results show that the lamps containing the electrodes as prepared above had superior lumen output than two control groups. In addition, the critical minimum starting volts to assure starting reliability at −20° F. was measured in the test lamps after 100 hours. The minimum starting volts of less than 161 volts was favorable. The nominal lamp operation in volt for the lamps containing the above electrodes remained constant for 100 hour and 500 hour tests.

In another life test to evaluate the $BSY_2$ electrode emissive coating in H100W and H175W lamps, lamps were aged to 3000 and 2000 hours respectively. The H100W test results show the $BSY_2$ containing lamps to be superior in lumen output to the controls. The lumen output, nominal lamp operating voltage and minimum starting voltage at −20° F. all meet required lamp specifications. The $BSY_2$ containing H175W lamps have a 5% lower lumen maintenance than the controls. The nominal lamp operating voltage is well within the 130 V specification.

We claim:

1. A high pressure mercury vapor arc discharge tube comprising a pair of electrodes sealed through opposite ends thereof, a fill within said tube consisting essentially of mercury and a starting gas, and means to connect current to each electrode of said pair of electrodes, each of said electrodes includes a rod portion and an encircling coil comprising an inner coil section and an outer coil section, said outer coil section being backwound over said inner coil section whereby recesses are created between said inner coil section and said outer coil section, and an emissive material disposed in said recesses, said emissive material consisting essentially of a single phase compound being characterized by the absence of additional separate phases comprising barium carbonate, strontium carbonate and yttrium oxide wherein said single phase comprises reacted $Ba_xSr_{1-x}Y_2O_4$ wherein x is from about 0.05 to about 0.95.

2. A high pressure mercury vapor arc discharge tube according to claim 1 wherein said emissive material disposed on each electrode consist essentially of a single phase reacted compound having a formula $Ba_xSr_{1-x}Y_2O_4$ wherein x is form about 0.25 to about 0.75.

3. A high pressure mercury vapor arc discharge tube according to claim 2 wherein the molar ratio of (Ba+Sr)/Y is from about 0.5 to about 0.3.

* * * * *